US005765378A

United States Patent [19]

Stein et al.

[11] Patent Number: 5,765,378

[45] Date of Patent: Jun. 16, 1998

[54] METHOD AND APPARATUS FOR DETECTING A LOSS OF DIFFERENTIAL PRESSURE IN A CRYOGENIC REFRIGERATOR

[75] Inventors: Martin L. Stein, Bedford; Robert E. Khederian, Canton; Robert D. Welch, Mansfield, all of Mass.

[73] Assignee: Helix Technology Corporation, Mansfield, Mass.

[21] Appl. No.: 774,408

[22] Filed: Dec. 31, 1996

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS 5,245,830 9/1993 Aubrun et al. ..... 62/6

5,535,593 7/1996 Wu et al. ..... 62/6

*Primary Examiner*—Ronald C. Capossela

*Attorney, Agent, or Firm*—Hamilton, Brook, Smith & Reynolds, P.C.

[57] ABSTRACT

A method for detecting the absence of a pressure differential across a cryogenic refrigerator includes the following steps. At least one measurement of load in the refrigerator is taken during both a warmstroke and a coldstroke of a refrigeration cycle. These measurements are then compared to determine whether the differential load across the cryogenic refrigerator has been lost. A system for performing this method includes a compressor that circulates compressed gas through a compressed gas line routed through a cryogenic refrigerator. Within the refrigerator, a displacer is driven through a refrigeration cycle by a motor. A means for measuring the load on the motor is provided, and an electronic module monitors the load measurements to detect a loss of differential pressure across the refrigerator by comparing the load on the motor during the warmstroke to the load on the motor during the coldstroke.

22 Claims, 7 Drawing Sheets

METHOD AND APPARATUS FOR DETECTING A LOSS OF DIFFERENTIAL PRESSURE IN A CRYOGENIC REFRIGERATOR

BACKGROUND OF THE INVENTION

In various types of cryogenic refrigerators or cryogenic vacuum pumps (cryopumps), a working gas, such as helium, is introduced into a cylinder. The gas is then expanded at one end of a piston-like displacer to cool the cylinder. In refrigerators utilizing a Gifford-McMahon refrigeration cycle, for example, working gas under high pressure may be valved into the warm end of the cylinder. The gas is then driven through a regenerative heat exchange matrix (regenerator) as a result of a pressure differential between the supply and exhaust of the working gas and also as a result of the movement of the displacer. The gas, which has been cooled by the regenerator, is then expanded at the cold end of the displacer.

The movement of the displacer may be controlled by a mechanical drive such as a rotary motor which drives the displacer through a rotary to linear crosshead. The crosshead converts the rotary drive of the motor to a linear reciprocating motion which drives the displacer from end to end of the cylinder. To drive the displacer through each refrigeration cycle, the rotary motor must generate sufficient mechanical torque. The displacer may also be directly driven by a linear motor through the displacement cycle.

The cryogenic refrigerator typically receives the working gas from a compressor through a supply line. After the refrigerator processes the compressed gas while performing a refrigeration cycle, the spent gas is returned to the compressor from the refrigerator through an exhaust line. During optimal operation, the exhaust line is maintained at a lower gas pressure than the supply line, thereby creating a pressure differential across the cryogenic refrigerator which facilitates flow of the working gas into and out of the refrigerator and through the regenerator.

DISCLOSURE OF THE INVENTION

The cryogenic refrigerator, described above, may cease to perform as desired if the difference in pressure across the refrigerator is lost. This loss may be occasioned by a variety of factors. In applications for cryo-cooling or cryogenic vacuum pumping, the compressor is often remotely located from the refrigerator. For example, in semiconductor fabrication facilities, the compressor may not be located in the same clean room environment as the cryogenic vacuum pump. At various points along the circuit, the compressed gas line connecting the compressor to the refrigerator may become pinched or ruptured to defeat the flow of working gas and, accordingly, the maintenance of a pressure differential. Additional circumstances yielding a loss of pressure differential include compressor failure, a loss of power to the compressor, a broken seal or a disconnected line. Any of these circumstances may not be readily detected and continued use of the system under such circumstances will generally prove unproductive, may prove ruinous to the activity performed, and may damage the system.

The method of this invention monitors the existence of a pressure differential across a cryogenic refrigerator, i.e., between the compressed gas supply flowing into the cryogenic refrigerator and the gas exhaust flowing out. Maintenance of the pressure differential is necessary to ensure an adequate flow of compressed gas through the refrigerator. A motor drives the cryogenic refrigerator through a refrigeration cycle including a warmstroke and a coldstroke. The load on the motor during each of these strokes is measured, and at least one measurement from the warmstroke is then compared to at least one measurement from the coldstroke to determine whether the difference in pressure across the refrigerator has been lost.

In accordance with one aspect of the invention, refrigeration is performed by a motor-driven, reciprocating displacer performing a Gifford-McMahon cooling cycle with compressed helium as the working gas. The displacer is driven toward the cold end of a refrigeration cylinder during the coldstroke and driven toward the warm end during the warmstroke.

In a preferred embodiment of this method, multiple load measurements are taken during both the coldstroke and the warmstroke. These multiple measurements from each stroke are then compared to determine whether the difference in pressure between the inlet and the exhaust has been lost. The comparison preferably includes calculating for each stroke an average of load measurements taken during that stroke. The ratio of the average warmstroke load to the average coldstroke load is then calculated and compared to a control value. The control value may be a pre-established constant, or it may be a function of a ratio taken from preliminary measurements of load on the monitored system during operation. In a favored embodiment, the calculations are performed by an electronic module powered independently from the compressor to minimize the likelihood that a loss of power to the compressor will coincide with a loss of power to the electronic module and thereby escape detection.

One embodiment of the apparatus of this invention is a system that includes a compressor that circulates compressed gas through a compressed gas line routed through a cryogenic refrigerator. Within the refrigerator, a displacer is driven through a refrigeration cycle by a motor. A means for measuring the load on the motor is provided, and an electronic module monitors the load measurements to detect a loss of differential pressure across the refrigerator by comparing the load on the motor during the warmstroke to the load on the motor during the coldstroke.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily drawn to scale, emphasis instead being placed upon illustrating the principles of the invention.

DETAILED DESCRIPTION OF PREFERRED EMBODIMENT

In the refrigerator of a typical cryopump, the working fluid is compressed. The heat of compression is removed by air-cooled heat exchangers. The fluid is further cooled as it passes through a regenerative heat exchange matrix within a displacer, and the gas is then expanded to produce cooling below the ambient temperature. A cryopump typically operates at less than 20K to remove gas molecules from a work chamber. Achieving this low temperature requires the use of highly efficient heat exchangers and a working fluid, e.g., helium gas, that remains fluid at temperatures approaching absolute zero.

Figure 1:
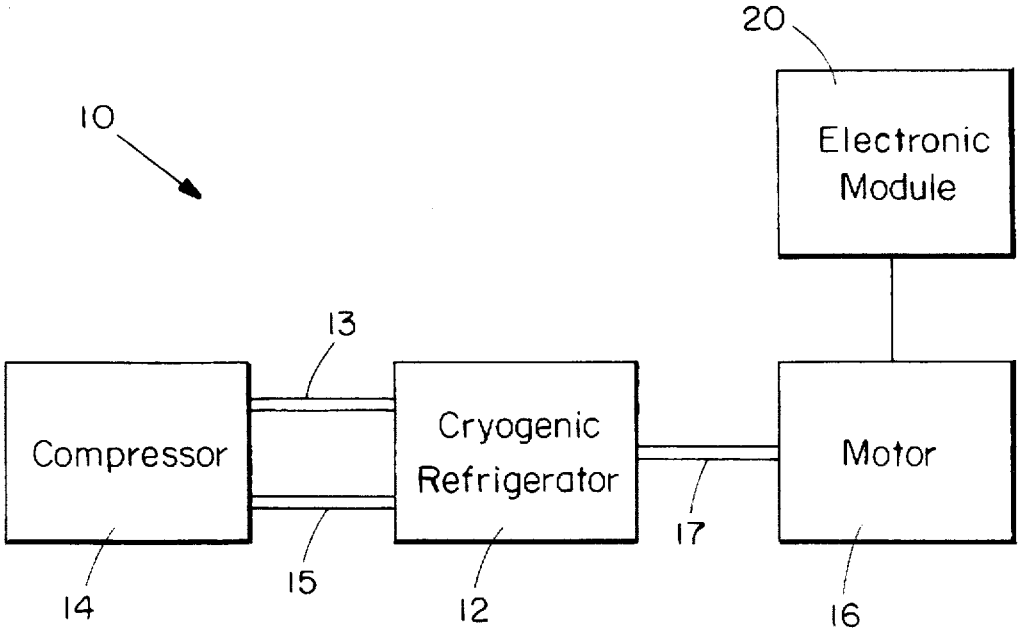
FIG. 1 is a schematic diagram of a cryogenic refrigeration system utilizing an electronic module for detecting a loss of pressure differential.

FIG. 1 illustrates an embodiment of a cryogenic refrigeration system 10 featuring an electronic module 20, which, in addition to directing the routine operation of the system, can also detect a loss of differential pressure. The electronic module 20 may be similar to that disclosed in U.S. Pat. No. 5,343,708, herein incorporated by reference. Compressed gas is supplied to the cryogenic refrigerator 12 through a compressed gas line 13 driven by a compressor 14 and returned to the compressor through an exhaust line 15. The cryogenic refrigerator 12 performs a refrigeration cycle when driven by a motor 16 through a shaft 17. The torque generated by the motor 16 as it drives the refrigeration cycle is monitored by the electronic module 20. The electronic module 20 monitors the torque measurements to determine whether a difference in pressure exists between the gas entering and exhausted from the cryogenic refrigerator 12. A loss of differential pressure is detected by evaluating the wave pattern representing the torque generated by the motor 16 over the course of its mechanical cycle, which parallels the refrigeration cycle.

The electronic module 20 is powered by a source independent of the compressor 14. An example of such a source is a direct 220 volt line. This feature advantageously reduces the likelihood that a loss of power to the compressor 14 will coincide with a loss of power to the electronic module 20. Accordingly, the electronic module 20 can thereby detect the loss of a pressure differential resulting from a loss of power to the compressor because the independent power source allows the electronic module 20 to continue to function after the compressor 14 fails.

Figure 2:
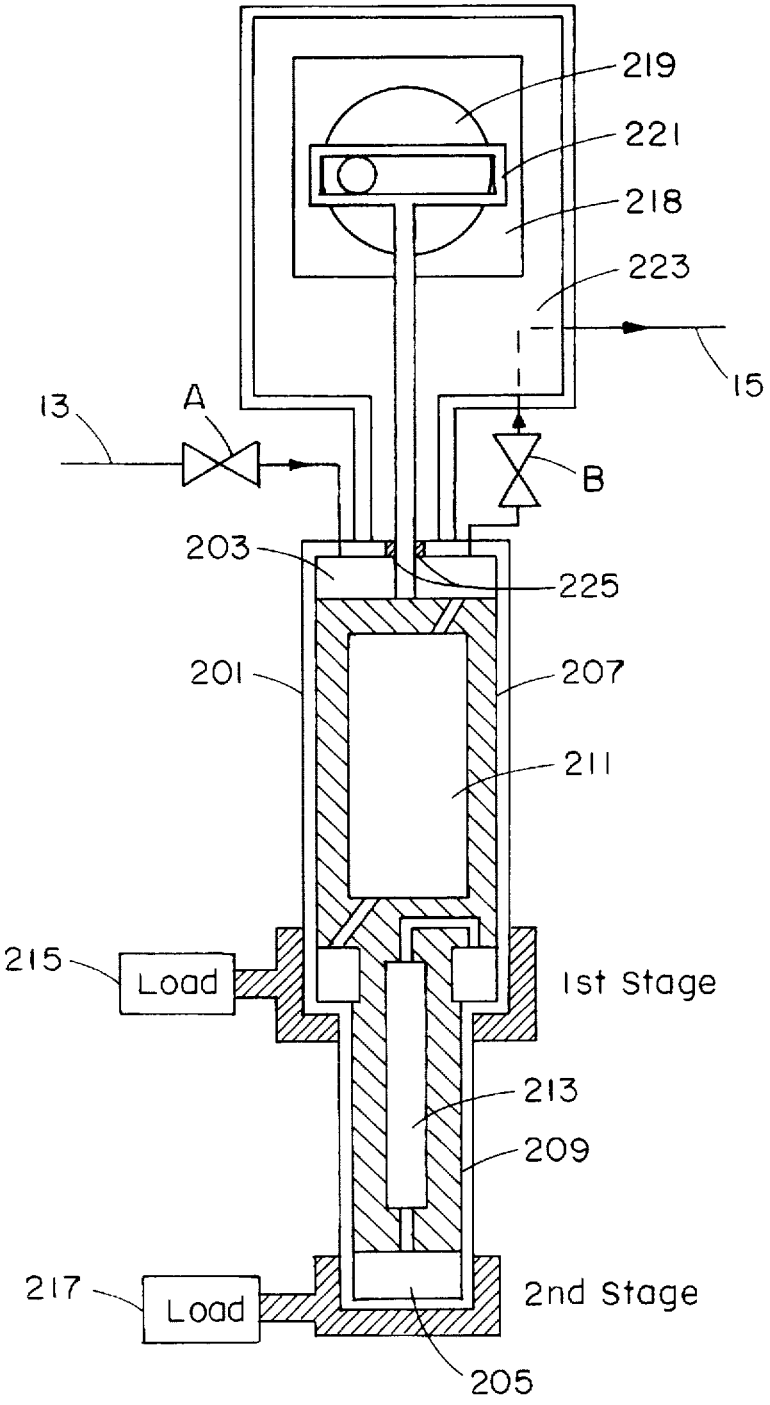
FIG. 2 is a cross-sectional diagram of a cryogenic refrigerator and motor assembly.

The flow of compressed gas in the cryogenic refrigerator utilizing a Gifford-McMahon cooling process is cyclic. FIG. 2 illustrates a two-stage cryogenic refrigerator along with the motor that drives it. Note, however, that the methods of this invention are likewise effective for single-stage refrigerators. Compressed gas flows from a compressor into a first end 203 of a refrigeration cylinder 201 through an inlet valve A. The gas is discharged from the first end 203 of the cylinder 201 through an exhaust valve B, through a drive chamber 223 and through the return line 15 to the low-pressure side of the compressor. Because the drive chamber is coupled to the low-pressure side of the compressor, the compressor consistently maintains the drive chamber at a low pressure. When the exhaust valve B is open, the compressor also evacuates the refrigeration cylinder 201 by extracting gas drawn from the cylinder 201 into the drive chamber 223. Within each stage of the refrigerator, a displacer 207/209 reciprocates. The displacers 207 and 209 each include a regenerator 211 and 213, respectively.

The synchronized valving and reciprocation of the displacer cool the helium gas which extracts heat from a first-stage thermal load 215 and a second-stage thermal load 217. In a typical cryopump, such as that disclosed in U.S. Pat. No. 5,156,007, herein incorporated by reference, the first-stage thermal load 215 includes a radiation shield and a frontal array. The second-stage thermal load 217 is typically a low-temperature array, which acts as the primary pumping surface for condensation of low-boiling point gases.

A regenerator is a reversing-flow heat exchanger through which the compressed gas passes alternately in either direction. The regenerator comprises a material of high surface area, high specific heat, and low thermal conductivity. Thus, it will accept heat from the helium if the helium's temperature is higher and release this heat to the helium if the helium's temperature is lower. The regenerator extracts heat from the incoming helium during the warmstroke toward the warm end, stores the heat, and then releases it to the cooled exhaust stream during the coldstroke.

While the refrigerator is operating, the displacers 207 and 209 linearly reciprocate within the cylinder 201 as the inlet A and exhaust B valves are cyclically regulated. With the second-stage displacer 209 at the second end 205 of the cylinder 201, and with the exhaust valve B closed and the inlet valve A open, the cylinder fills with compressed gas. With the inlet valve A still open, the displacers begin a warmstroke during which a motor 218 drives them toward the warm, first end 203. During the warmstroke, compressed gas is forced through the regenerators 211 and 213 where heat is extracted from the incoming gas.

Following the warmstroke is a coldstroke. With the exhaust valve B open and the inlet valve A closed, the motor 218 drives the displacers back toward the cold, second end 205, displacing the expanding gas back through the regenerators 211 and 213. As the exhausted gas expands, it extracts heat from thermal loads 215 and 217, thereby performing refrigeration. The existence of a pressure differential is necessary to drive the working gas into and out of the refrigeration cylinder 201 as well as to help drive the working gas through the regenerators 211 and 213.

A displacer drive motor 218 is housed within a lowpressure drive chamber 223. Gas within the chamber 223 is isolated from gas within the refrigeration cylinder 201 by seals 225. The motor 218 delivers a driving force through a rotor 219. The rotation of the rotor 219 is then converted by a crosshead 221 into an axially-reciprocating motion which drives the displacers 207 and 209.

Figure 3:
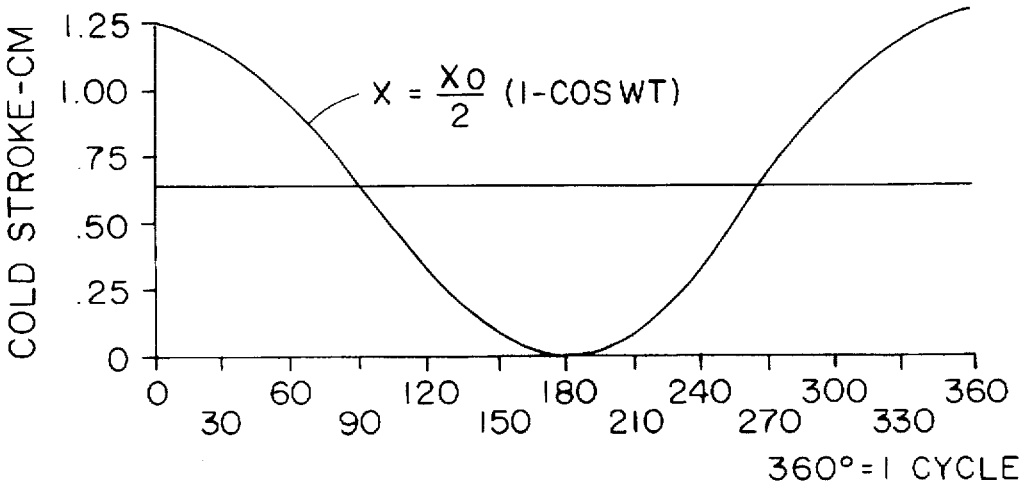
FIG. 3 plots, in the form of a graph, the position of the displacer relative to the second end of the refrigeration cylinder over the course of one mechanical cycle.
Figure 4:
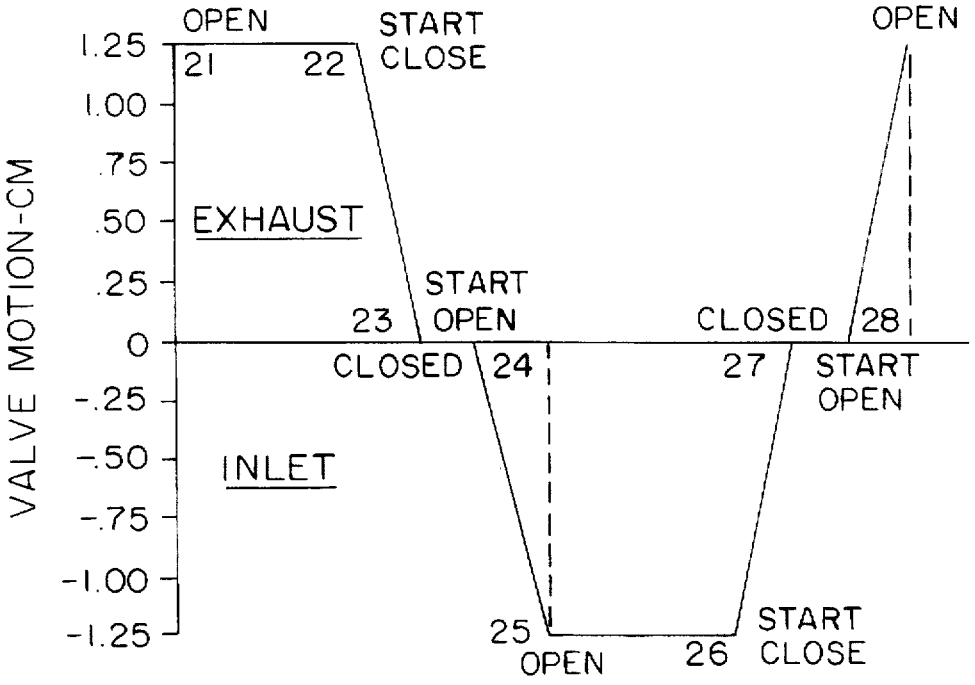
FIG. 4 is a graph illustrating the sequence of the opening and closing of both the inlet and exhaust valves over the course of one mechanical cycle.

FIGS. 3 and 4 provide additional illustration of the sequential mechanics of the gas flow and displacer motion. FIG. 3 charts the position of the displacer(s) within the refrigeration cylinder. FIG. 4, meanwhile, illustrates the sequential operation of valves supplying and removing gas from the refrigeration cylinder over the same cycle. The coldstroke, which extracts heat from the thermal loads, commences at point 21 (0°). The displacer, which is at the first end of the cylinder, begins to move toward the second end, and the exhaust valve is fully open. As a result, very cold gas is displaced through the regenerator to cool the regenerator. The exhaust valve begins to close at point 22. At point 23, the exhaust valve is fully closed. After a brief dwell, the inlet valve begins to open at point 24 and reaches its fully-open position at point 25 (180°) when the displacer reaches the second end of the cylinder.

The following sequence, from 180° to 360°, is referred to as the warmstroke, during which the comparatively-warm incoming gas is displaced through and cooled by the regenerator. With the inlet valve open, the displacer starts moving back toward the first end at point 25. At point 26, the inlet valve begins to close and reaches full closure at point 27. After another brief dwell, operation again shifts to the exhaust valve which begins to open at point 28. With the exhaust valve opened the volume of precooled gas at the second end expands to cool further and extract heat from the load. The cycle is completed when the exhaust valve reaches its fully open position and the displacer returns to the first end at point 21 (360° or 0°).

Figure 5A:
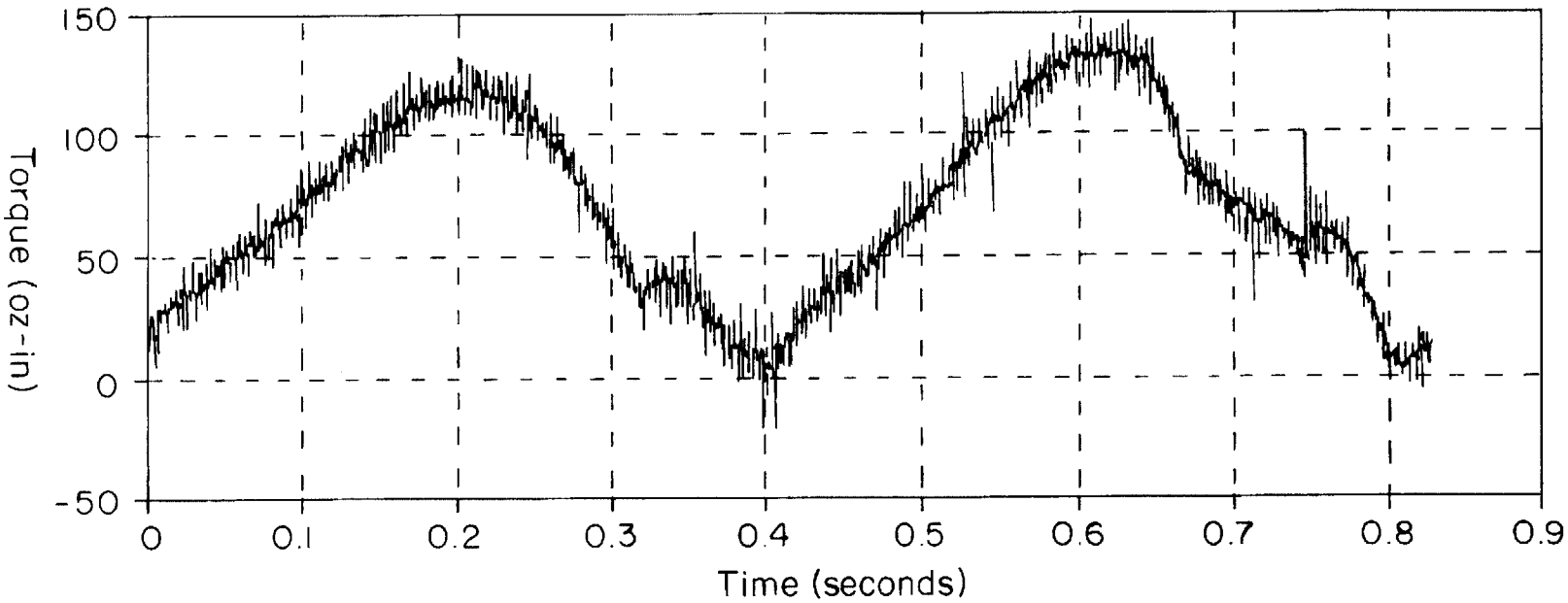
FIG. 5A is a graph charting the torque generated by the motor over one mechanical cycle performed in the absence of a pressure differential in the refrigeration cylinder.

As the motor drives the displacer through this reciprocating cycle within the cylinder, torque is generated by the motor. The magnitude of the torque generated by the motor over the course of the cycle follows a path roughly that of the absolute value of a sinusoid when plotted from 0° to 360°. FIG. 5A illustrates the torque characteristics of a Gifford-McMahon drive motor over the course of a cycle performed in the absence of a pressure differential. As shown, the peaks are roughly symmetrical, with the torque peaking at a slightly higher level during the warmstroke, at approximately 0.6 seconds, than during the coldstroke, at approximately 0.2 seconds. The average torque generated during the warmstroke (calculated as 73.89 oz-in and measured between approximately 0.4 and 0.8 seconds) is also higher than the average torque generated during the coldstroke (calculated as 66.59 oz-in and measured between approximately 0 and 0.4 seconds). Similar results have also been obtained using various other displacer speeds and pump orientations.

The torque generated by the motor is closely related to displacer velocity. Within each stroke, torque is greatest at approximately the midpoint of the displacer's passage between the first and the second end of the refrigeration cylinder. At the midpoint, the moment arm of the mechanical cycle reaches its greatest value. In contrast, the moment arm (and, correspondingly, the torque) approaches zero at the endpoint of the displacer's reciprocation at either end of the cylinder.

More specifically, the torque is a product of several counteracting forces including the inertia of the displacer, the fluid friction resulting from the drag flow of gas through the displacer, the pressure differential between the refrigeration cylinder and the drive chamber (as distinguished from the pressure differential between the inlet and outlet valves), the Coulombic friction caused by the seals acting upon the displacer, and the force of gravity. The inertial forces are relatively small and the pressure differential between the refrigeration cylinder and the drive chamber is constant where no difference in pressure exists between the inlet and outlet valves. Meanwhile, the gravitational force supplies a slight increase in torque when the displacer is moving up and a slight decrease in torque when the displacer is moving down. Accordingly, the remaining forces, i.e., the fluid drag force and the Coulombic friction, are the principal producers of the roughly sinusoidal shape of the torque pattern.

Figure 5B:
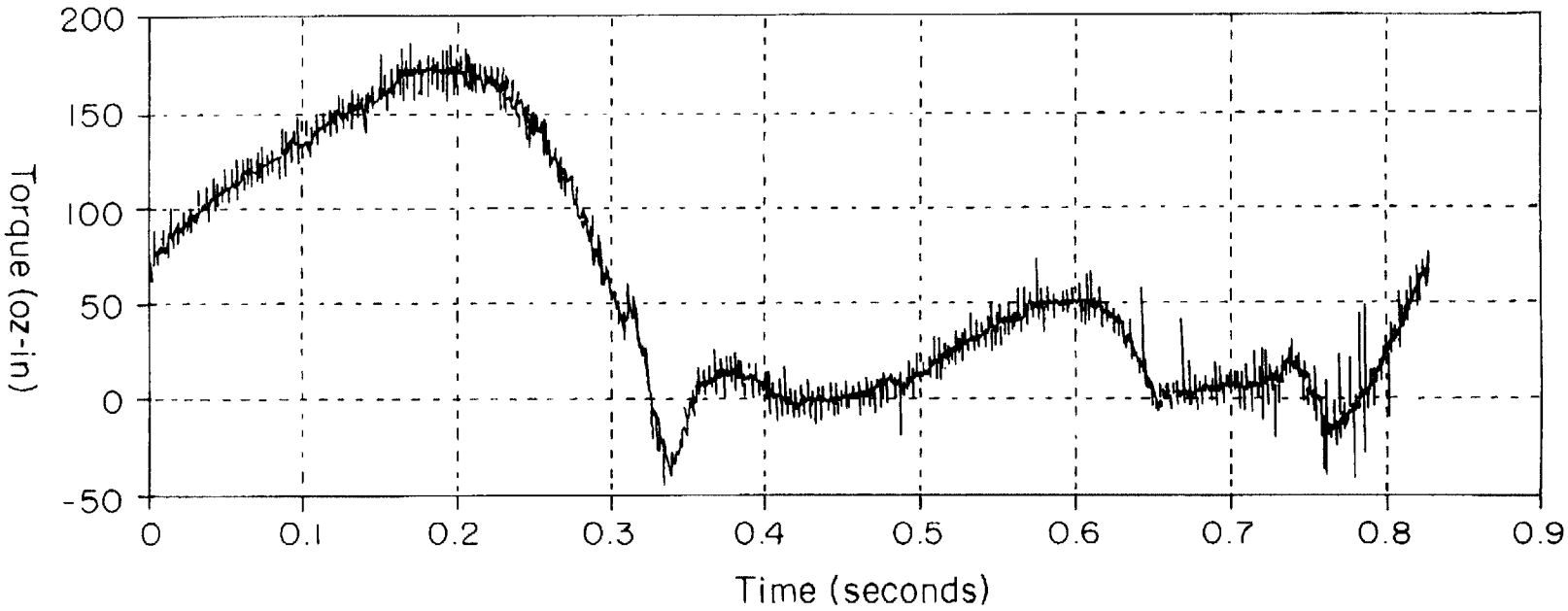
FIG. 5B charts the torque generated by the motor over one mechanical cycle performed with a supply of working gas and a pressured differential in the refrigeration cylinder.

In contrast to the roughly-sinusoidal curve produced in the absence of a pressure differential, the torque signature produced during normal operation when a pressure differential exists, as shown in FIG. 5B, takes on a significantly different shape. FIG. 5B clearly demonstrates that the average torque, 18.87 oz-in, generated during the warmstroke (measured between approximately 0.33 seconds and approximately 0.75 seconds) is much less than the average torque, 99.01 oz-in, generated during the coldstroke. Comparing FIGS. 5A and 5B, one can see that the creation of a pressure differential between the two strokes greatly decreases the peak and average torque generated during the warmstroke in comparison to the peak and average torque generated during the coldstroke. Average torque is calculated by adding all torque measurements within a stroke and dividing by the number of points.

The shift in the torque signature pattern when an inlet-exhaust pressure differential is supplied is primarily a product of the fluctuating pressure differential between the drive chamber and the refrigeration cylinder. These fluctuations, in turn, result from the pattern of opening and closing the inlet and exhaust valves, as illustrated in FIG. 4, and its effect on the pressure within the refrigeration cylinder.

For example, during much of the warmstroke, the inlet valve is open, creating high pressure within the refrigeration cylinder. The drive chamber surrounding the motor, however, remains at low pressure because it is in fluid contact with the low-pressure exhaust line. The difference in pressure between the low-pressure drive chamber and the high-pressure refrigeration cylinder produces a force pushing the displacer from the refrigeration cylinder into the drive chamber, thereby reducing the amount of torque required by the motor to pull the displacer toward the warm end of the cylinder.

Throughout much of the coldstroke, the exhaust valve is open. As a result, the pressure in both the drive chamber and the refrigeration cylinder approaches an equilibrium with the low-pressure exhaust line. However, the drag of the gas flowing out of the cylinder opposes the motion of the displacer, thereby increasing the load on the motor as it drives the cycle. Consequently, the load on the motor during the warmstroke is typically greater with differential pressure than without.

In light of the characteristic torque signature generated in the presence of a pressure differential, as shown by the test results illustrated in FIG. 5B, an algorithm can be employed to monitor for a shift in the ratio of the average torque generated during the warmstroke to the average torque generated during the coldstroke. Similar shifts in this ratio have been detected at a variety of displacer speeds and pump orientations. Therefore, a loss of the pressure differential can routinely be detected by monitoring for a shift in the ratio of the average torque values from each stroke.

The torque signatures shown in FIGS. 5A and 5B are typical for refrigerators oriented with the cold end facing up and the warm end facing down. This orientation is one that would likely exist when a cryopump is mounted to the bottom of a work chamber. Under such conditions, the loss of a pressure differential between the inlet and the exhaust of the refrigeration cylinder can be detected by simply monitoring whether the average torque generated during the warmstroke exceeds the average torque generated during the coldstroke. If so, differential pressure has been lost, and an appropriate response can be quickly provided. To eliminate the effects of a momentary loss of power to the compressor, the criteria are observed over several mechanical cycles.

In contrast, where a refrigerator is oriented in an opposite direction, such that the cold end is at the bottom, the force of gravity will be opposite to that in the previous example and the torque signature will shift. This shift includes an increase in coldstroke torque and a decrease in warmstroke torque. As a result of the shift, the torque generated during the coldstroke will exceed that generated during the warmstroke by a small amount when no pressure differential exists. Nonetheless, the shift in the torque signature will still produce a sufficient shift in the ratio of average torque values to detect a loss of the pressure differential. Therefore, when orientation of the refrigerator is reversed, the algorithm for detecting a loss of differential pressure need only be modified by lowering the value with which the ratio of the average warmstroke torque to the average coldstroke torque is compared. For example, the value may be set at 0.5. Accounting for the orientation and idiosyncracies of any given refrigerator, a control value can be particularly selected and compared to the ratio of average warmstroke torque to average coldstroke torque in a particular refrigerator to determine whether differential pressure in that refrigerator has been lost.

Another method of detecting a loss of differential pressure in the gaseous fluid is by using an algorithm based on power. Power can be calculated as follows:

$$\text{Power}=\text{Speed}*\text{Torque}/1352.$$

Figure 6A:
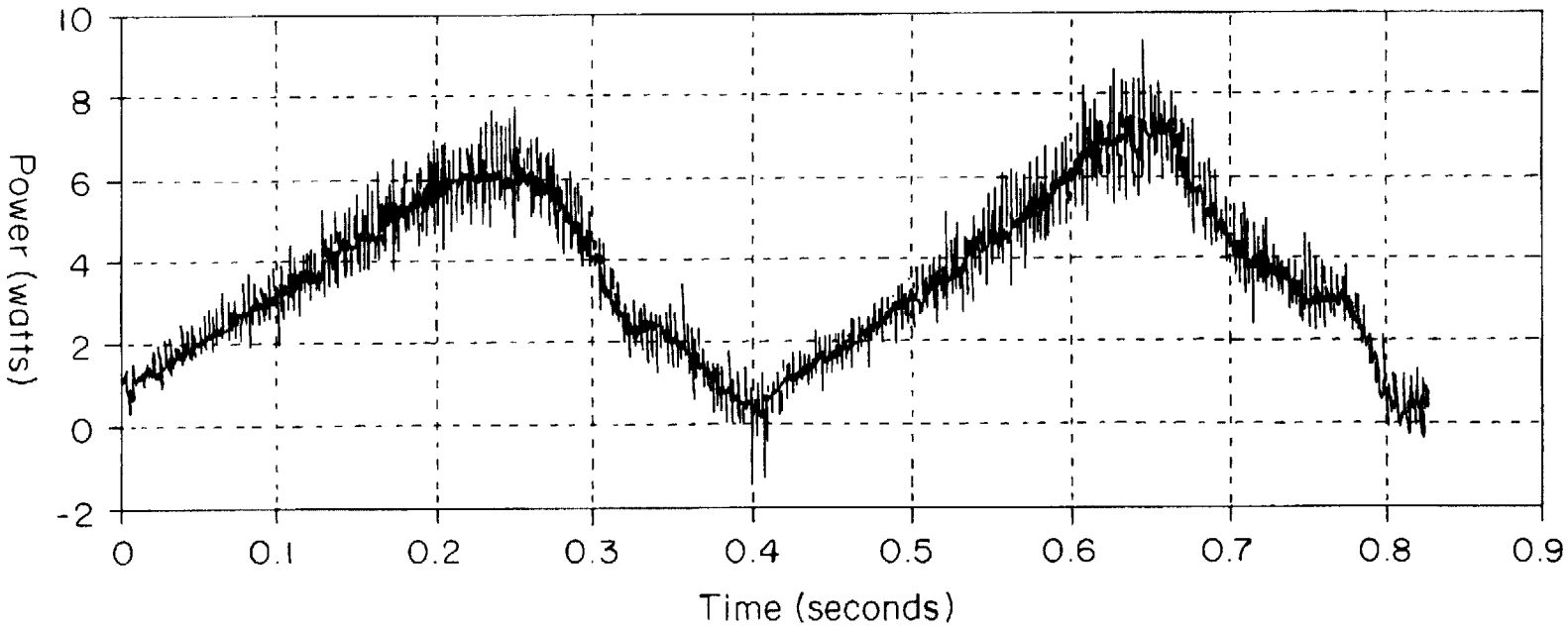
FIG. 6A, another graph, tracks the power consumed by the motor over one mechanical cycle performed in the absence of a pressure differential in the refrigeration cylinder.
Figure 6B:
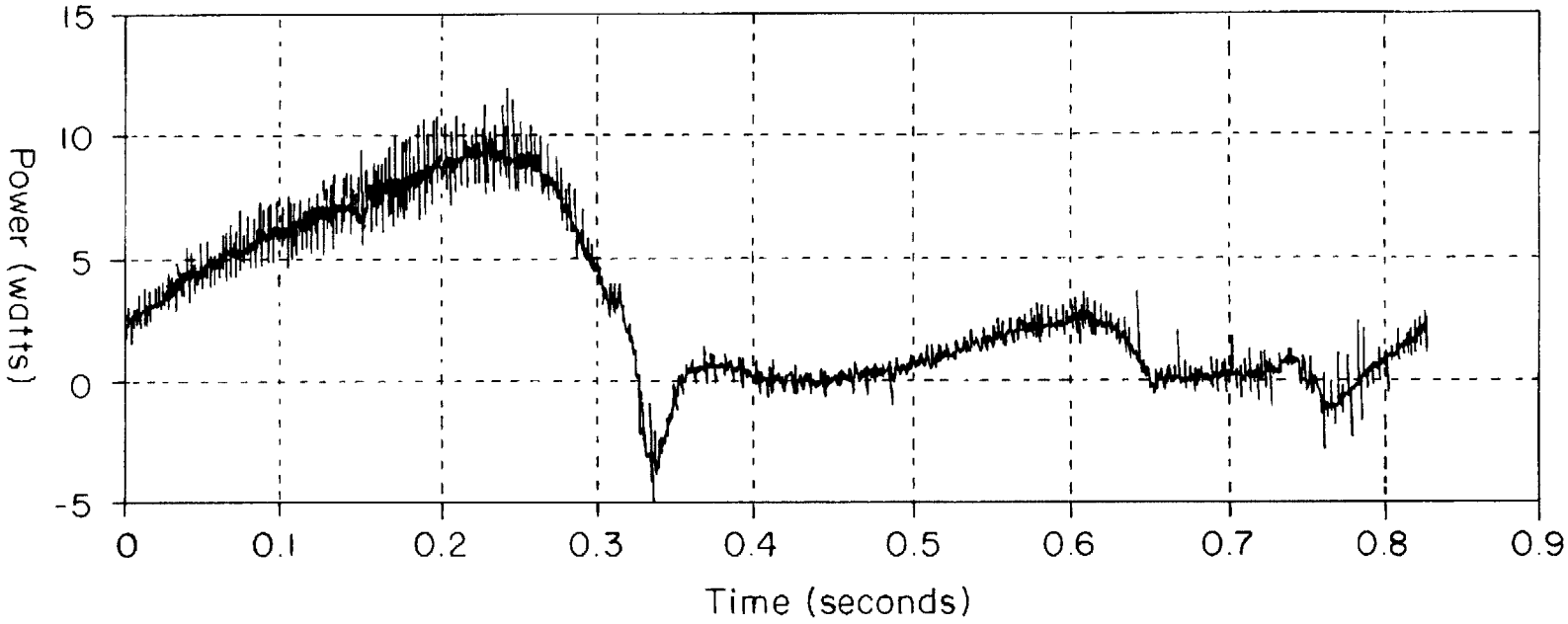
FIG. 6B, the final graph, tracks the power consumed by the motor over one mechanical cycle performed with a supply of working gas and a pressure differential in the refrigeration cylinder.

Wherein, speed is motor speed in RPM and Torque is motor torque in oz-in. Where speed is constant, torque and power are linearly related such that the same algorithms used to monitor torque for a loss of differential pressure can also be used to monitor power for the same condition. The power generated by the motor over the course of a refrigeration cycle in the absence, as well as in the presence, of a pressure differential in the working gas is illustrated in FIGS. 6A and 6B, respectively. Both tests were performed with the refrigerator oriented such that the warm end was on the bottom. In the absence of a pressure differential, as shown in FIG. 6A, an average power of 3.451 watts was measured during the warmstroke, while an average power of 3.809 watts measured during the coldstroke. When a pressure differential was provided, as shown in FIG. 6B, an average power of 4.996 watts was measured during the warmstroke, while an average power of 0.8863 watts measured during the coldstroke. Because power is linearly related to torque, the forms of these signatures match closely with the torque signatures shown in FIGS. 5A and 5B. Likewise, either measurement provides a means for determining the load on the motor.

A brushless, three-phase motor is typically used as the drive motor in a cryopump. When operating this motor, both torque and power can be determined using measurements from current sensors and a position sensor. The current sensors and the position sensor are typically inherent in preexisting systems as the sensors are used to provide closed-loop feedback to maintain constant speed of the motor. Therefore, determining torque and power does not require the implementation of any additional sensors beyond those that are already in use.

In the closed-loop feedback system, current sensors are required to achieve fast torque response in the presence of varying load. Meanwhile, the position sensor is required both to allow proper commutation of the three phases of the motor and to estimate a velocity signal, which is required for closed-loop speed control. For a brushless, DC motor, the torque-producing component of current may be derived mathematically given the position of the rotor and the current measurement of two of the three phases. Once the torque-producing current, $I_q$, has been computed, motor torque for a brushless three-phase motor is computed as follows:

$$\text{Torque}=K*N*I_q$$

Wherein, K is the torque constant in the d–q rotor frame reference. N is the number of pole pairs, and $I_q$ is the torque-producing component of current in the d–q rotor reference frame.

Power, on the other hand, may be computed as follows:

$$\text{Power}=\text{speed}*\text{torque}/1352$$

Wherein, speed is motor speed in RPM, and torque is motor torque in oz-in. Torque is calculated as described above. Speed, meanwhile, may be computed in its simplest form by differentiating the position of the rotor, as measured by the position sensor, with respect to time.

The detection of a loss of a pressure differential using these methods has been successfully tested and confirmed over a range of speeds from 0.25 Hz to 4.8 Hz and over a range in the temperature of the second stage from 10 to 300K. These methods have also been successfully tested using refrigerators of different sizes, configured as cryopumps. Using this method, a loss of the pressure differential in the working gas was detected and displayed on the operator control panel as "Loss of Compressor Gas." Once the pressure differential was restored, the message disappeared.

As an alternative to the use of the algorithms provided above, the ratio of the average coldstroke load to the average warmstroke load can be compared to a control value particularly tailored to the operation of the cryogenic refrigerator being monitored. The control value can be computed based on the ratio of the average coldstroke load to the average warmstroke load at a designated occurrence, such as at the close of a regeneration procedure when the refrigerator has reached its cold operating temperature. During a regeneration procedure, a cryopump is heated from its operating temperature to a sufficiently warm temperature to sublimate the bulk of gases condensed upon the cryopump. The cryopump is then re-cooled to its operating temperature.

Upon completion of regeneration, the ratio of the average coldstroke load to the average warmstroke load is calculated and recorded as a template ratio. Preferably, the measurements used to calculate the template ratio are taken with the refrigerator operating at its maximum intended speed for the process being performed. The control value is then set at the template ratio multiplied by 0.9. As the refrigerator continues to operate, subsequent measurements are taken and monitored. A loss of differential pressure is signaled if subsequently-measured ratios drop below this control value. This method will provide a control value particularly adapted to the conditions, idiosyncracies and orientation of the refrigerator being monitored. Further, the algorithm adapts to changes in pump performance over time since a new template ratio will be taken at the completion of every cryopump regeneration or at other designated occurrences, such as the passage of fixed periods of time.

Other factors, such as contamination or mechanical distress (short of outright failure) within the displacer drive mechanism, also can affect the torque generated by the motor. Unlike a loss of pressure differential, however, these factors typically produce a roughly equivalent increase in the torque generated during each stroke of the cycle. Whereas a loss of pressure differential distinctly skews the shape of the torque signature, mechanical distress or contamination usually shifts the torque curve upward but does not significantly alter its general shape. Therefore, mechanical distress or contamination generally does not significantly change the difference between the two torque peaks, and the ratio between the torque averages will usually not be sufficiently altered to falsely trigger the detection of a loss of pressure differential. Moreover, the electronic module can be programmed to distinguish between the distinct alteration of the curve that accompanies a loss of pressure differential and the uniform shift in torque values that accompanies contamination or mechanical distress.

We claim:

1. A method for detecting an absence of differential pressure across a cryogenic refrigerator, wherein a motor drives the cryogenic refrigerator through a refrigeration cycle including a warmstroke and a coldstroke, the method comprising the following steps:

taking at least one measurement of loading of the motor during the warmstroke of the refrigeration cycle;

taking at least one measurement of loading of the motor during the coldstroke of the refrigeration cycle; and comparing at least one measurement from the warmstroke with at least one measurement from the coldstroke as an indication of whether the differential pressure across the cryogenic refrigerator has been lost.

2. The method of claim 1, wherein the at least one measurement of load from each of the warmstroke and the coldstroke is a plurality of measurements from each of the warmstroke and the coldstroke, respectively.

3. The method of claim 2, wherein the comparison of warmstroke measurements with coldstroke measurements comprises the following steps:

calculating an average of the warmstroke measurements;

calculating an average of the coldstroke measurements;

calculating the ratio of the average of the warmstroke measurements to the average of the coldstroke measurements; and determining whether the ratio of the average of the coldstroke measurements to the average of the warmstroke measurements is greater than a control value.

4. The method of claim 3, wherein the control value is a function of a template ratio, wherein the template ratio is a ratio of preliminary coldstroke measurements to preliminary warmstroke measurements, wherein the preliminary measurements used to calculate the template ratio are taken while the refrigerator is operating with a pressure differential across the refrigerator.

5. The method of claim 4, wherein the control value is the product of the template ratio and a constant in the range of about 0.5 to about 0.9.

6. The method of claim 2, wherein the comparison of warmstroke measurements with coldstroke measurements comprises the following steps:

calculating an average of the warmstroke measurements;

calculating an average of the coldstroke measurements;

calculating the difference of the average of the warmstroke measurements and the average of the coldstroke measurements; and determining whether the difference of the average of the warmstroke measurements and the average of the coldstroke measurements is greater than a control value.

7. The method of claim 2, wherein the load measurement is performed by measuring the torque generated by the motor as it drives the refrigeration cycle.

8. The method of claim 7, wherein the cryogenic refrigerator includes a displacer driven by the motor to channel the compressed gas through the refrigeration cycle.

9. The method of claim 8, wherein both pluralities of torque measurements are taken during a single sequence of the warmstroke and the coldstroke.

10. The method of claim 9, wherein the cryogenic refrigerator utilizes a Gifford-McMahon cooling cycle to achieve refrigeration.

11. The method of claim 10, wherein the compressed gas is circulated by a compressor and the calculations are performed by an electronic module powered independently from the compressor.

12. The method of claim 11, wherein the compressed gas is compressed helium.

13. A method for detecting an absence of differential pressure across a cryogenic refrigerator comprising the following steps:

supplying compressed gas through a supply line to the cryogenic refrigerator;

using a motor to drive a displacer that displaces the compressed gas through a refrigeration cycle within the cryogenic refrigerator, the refrigeration cycle including a warmstroke and a coldstroke, wherein driving the displacer loads the motor;

taking a plurality of measurements of the load of the motor during the warmstroke of the refrigeration cycle;

returning the compressed gas from the cryogenic refrigerator through a return line to the compressor;

taking a plurality of measurements of the load of the motor during the coldstroke of the refrigeration cycle; and comparing the plurality of measurements from the warmstroke with the plurality of measurements from the coldstroke to determine whether a ratio of the coldstroke measurements to the warmstroke measurements has reached a level indicating that no difference in pressure between the gas in the supply and return lines exists.

14. A method for detecting an absence of differential pressure across a cryogenic refrigerator comprising the following steps:

compressing helium gas;

supplying the compressed helium gas from the compressor through a supply line to a refrigeration cylinder within the cryogenic refrigerator;

using a motor to drive a displacer through a cycle including a warmstroke and a coldstroke, wherein driving the displacer loads the motor;

returning the helium gas from the cryogenic refrigerator to the compressor;

taking a plurality of measurements of the load of the motor during the warmstroke;

taking a plurality of measurements of the load of the motor during the coldstroke;

calculating an average warmstroke load by adding the load measurements taken during the warmstroke of one cycle and dividing by the number of measurements taken during the stroke;

calculating an average coldstroke load by adding the load measurements taken during the coldstroke of one cycle and dividing by the number of measurements taken during the stroke; and comparing the average coldstroke load with the average warmstroke load to determine whether a loss of differential pressure has occurred.

15. The method of claim 14, wherein the comparison of the average warmstroke load with the average coldstroke load comprises determining whether the ratio of the average coldstroke load to the average warmstroke load is greater than a control value.

16. A cryogenic refrigerator system comprising:

a cryogenic refrigerator including a refrigeration cylinder having a first end and a second end, wherein the cryogenic refrigerator operates using a refrigeration cycle performed within a refrigeration cylinder within the cryogenic refrigerator, the refrigeration cycle including a warmstroke and a coldstroke;

a motor mechanically coupled to a displacer within the cylinder, the displacer aligned for axial movement within the cylinder, the displacer also axially reciprocating within the cylinder when driven by torque generated by the motor, wherein the displacer performs the warmstroke when moving toward the first end of the cylinder and performs the coldstroke when moving toward the second end;

a compressor;

a compressed gas line tracing a circuit from the compressor through the cylinder, wherein the compressed gas is directed through the refrigeration cycle, and back to the compressor; and a means for measuring loading of the motor; and an electronic module including programmed electronics for comparing the load during the warmstroke with the load during the coldstroke to determine whether a loss of differential pressure has occurred.

17. The system of claim 16, wherein the electronic module is powered independently from the compressor.

18. The system of claim 17, wherein the programmed electronics include:

a means for calculating a ratio of the average of the warmstroke load measurements to the average of the coldstroke load measurements; and a means for comparing the ratio to a control value.

19. A cryogenic refrigerator comprising:

a refrigeration cylinder including a displacer aligned for reciprocal movement within the cylinder;

a motor for driving the displacer through the reciprocal movement, the reciprocal movement creating cooling through a refrigeration process, the refrigeration process including a warmstroke and a coldstroke;

a means for measuring load in the cryogenic refrigerator; and an electronic module including programmed electronics for comparing the load during the warmstroke to the load during the coldstroke to determine whether a loss of differential pressure has occurred.

20. The cryogenic refrigerator of claim 19, wherein the comparison of the warmstroke load and the coldstroke load includes comparing a plurality of torque measurements from the warmstroke with a plurality of measurements from the coldstroke.

21. An electronic module for detecting an absence of a pressure differential between gas flowing into and out of a cryogenic refrigerator driven by a motor, wherein loading of the motor is measured during both a warmstroke and a coldstroke of a refrigeration cycle, the electronic module comprising:

a means for receiving measurements of load on the motor; and programmed electronics for comparing load during the warmstroke with load during the coldstroke to determine whether a loss of differential pressure has occurred.

22. The cryogenic refrigerator of claim 21, wherein the comparison of warmstroke load and coldstroke load includes comparing a plurality of load measurements from the warmstroke with a plurality of load measurements from the coldstroke.

* * * * *